United States Patent [19]

Zaltsman

[11] Patent Number: 4,513,870

[45] Date of Patent: Apr. 30, 1985

[54] BOTTLE WITH A ONE-PIECE CORKING MEANS

[75] Inventor: Efim Zaltsman, Brooklyn, N.Y.

[73] Assignee: Monarch Wine Co., Inc., Brooklyn, N.Y.

[21] Appl. No.: 576,611

[22] Filed: Feb. 3, 1984

Related U.S. Application Data

[63] Continuation-in-part of Ser. No. 223,894, Jan. 9, 1981, abandoned, and Ser. No. 384,758, Jun. 3, 1982, Pat. No. 4,429,799.

[51] Int. Cl.[3] ..... B65D 1/02; B65D 55/16

[52] U.S. Cl. ..... 215/31; 215/253; 215/306

[58] Field of Search ..... 215/306, 31, 253; 220/375

[56] References Cited

U.S. PATENT DOCUMENTS 3,994,409 11/1976 Nightengale ..... 215/306 X
4,054,221 10/1977 Glover ..... 215/306 X

FOREIGN PATENT DOCUMENTS 2200857 7/1973 Fed. Rep. of Germany ..... 215/306

*Primary Examiner*—Donald F. Norton
*Attorney, Agent, or Firm*—Kirschstein, Kirschstein, Ottinger & Israel

[57] ABSTRACT

For use with a bottle containing pressurized carbonated water-based liquid contents and having an elongated neck portion with at least one annular flange adjacent its mouth, a corking unit of a one-piece elastomeric construction comprising a stopper with a head and a ring below and spaced from the head and molded and concentric with the stopper, the ring being located above the flange upon initial reception of the stopper in the neck, the internal diameter of the ring being slightly less than the internal diameter of the flange and the ring being capable of being pushed down mechanically over the flange in order to be above to be expanded upon passage over the flange and to constrict below the flange for captive retention on the neck, and a set of flexible elongated tethers having one end connected to the ring and the other to the head, the points of connection of the tethers to the ring being mutually spaced and the points of connection of the tethers to the head being mutually spaced, the tethers being folded as molded and each tether having a length as molded substantially greater than the distance between its ends as molded, each tether including a pair of branches and a retroverted bend interconnecting the same, the retroverted bend of one tether facing and being adjacent the retroverted bend of the other tether, and an energy-absorbing link joining the retroverted bends and molded in one piece with the tethers, said link assimilating a portion of the force that would tend to propel the stopper away from the neck upon removal of the stopper from the neck.

11 Claims, 17 Drawing Figures

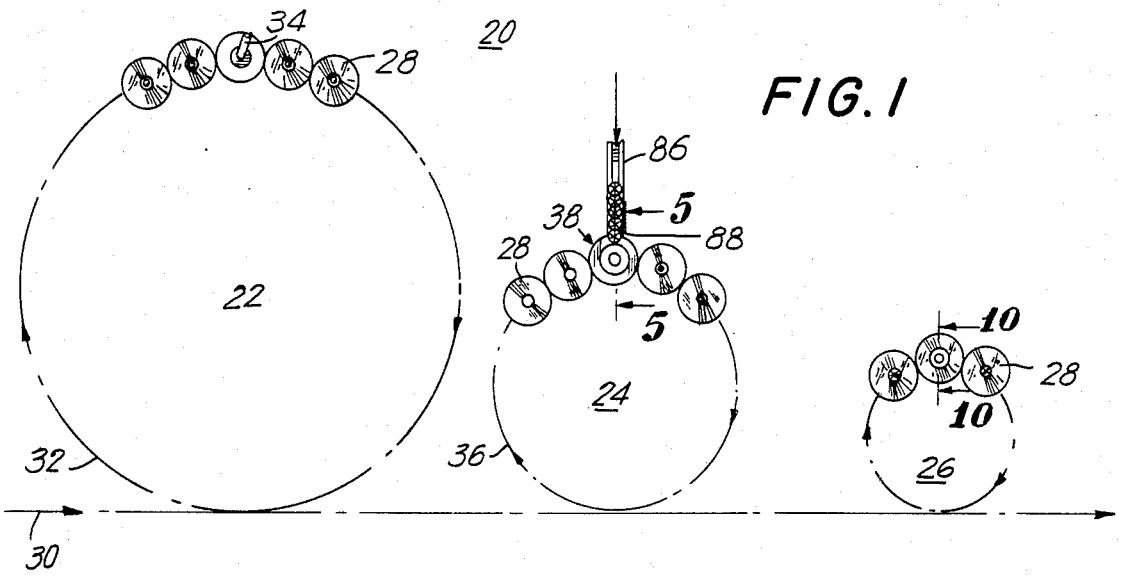
FIG. 1
FIG. 2
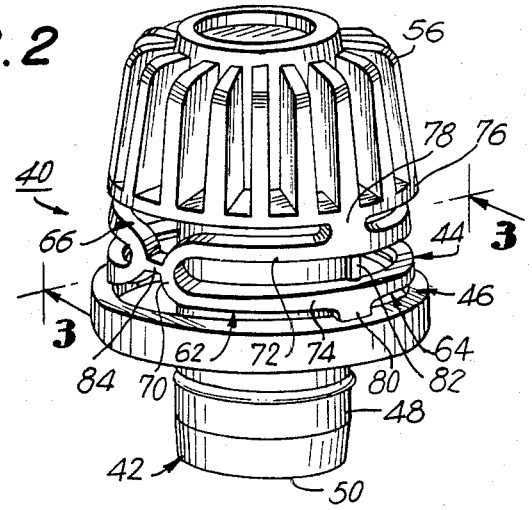
FIG. 3
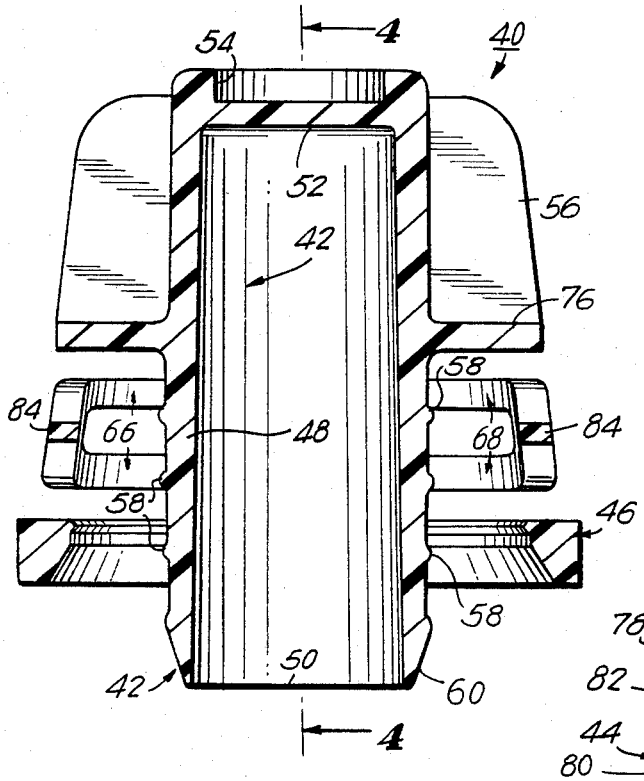
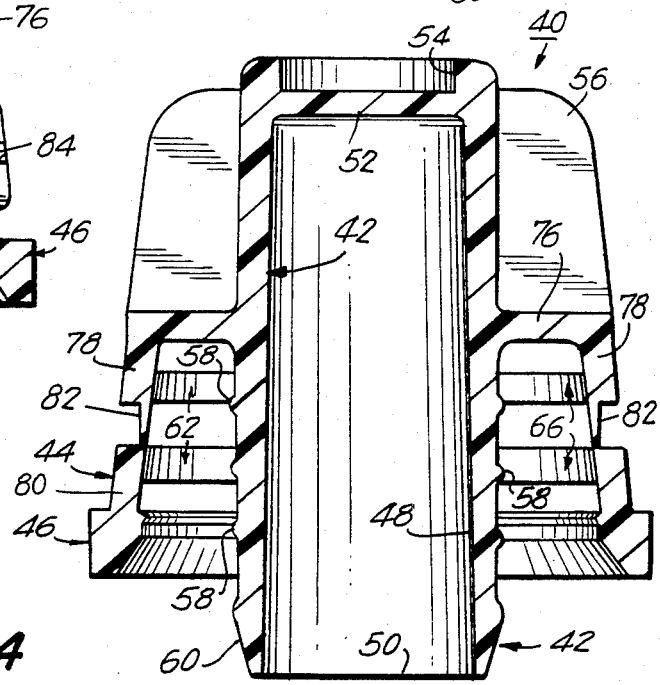
FIG. 4

FIG. 15
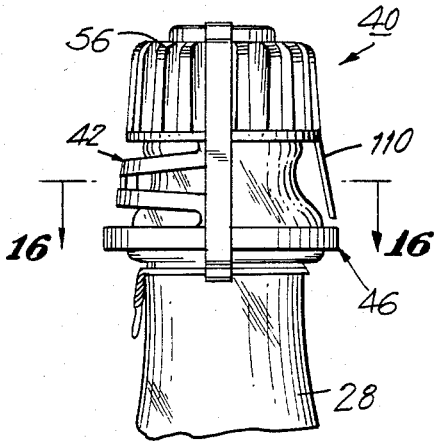
FIG. 16
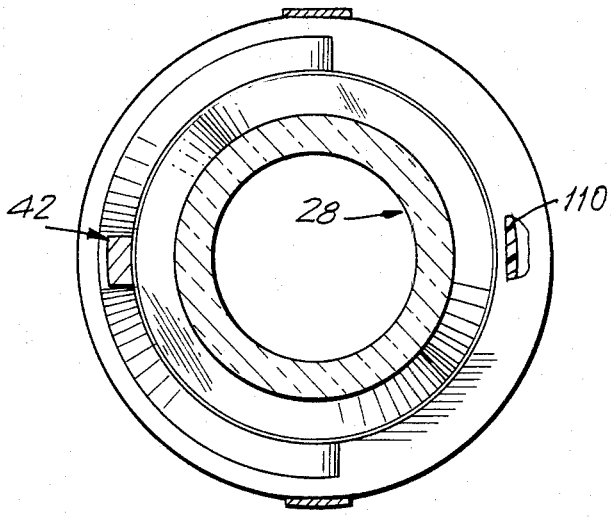
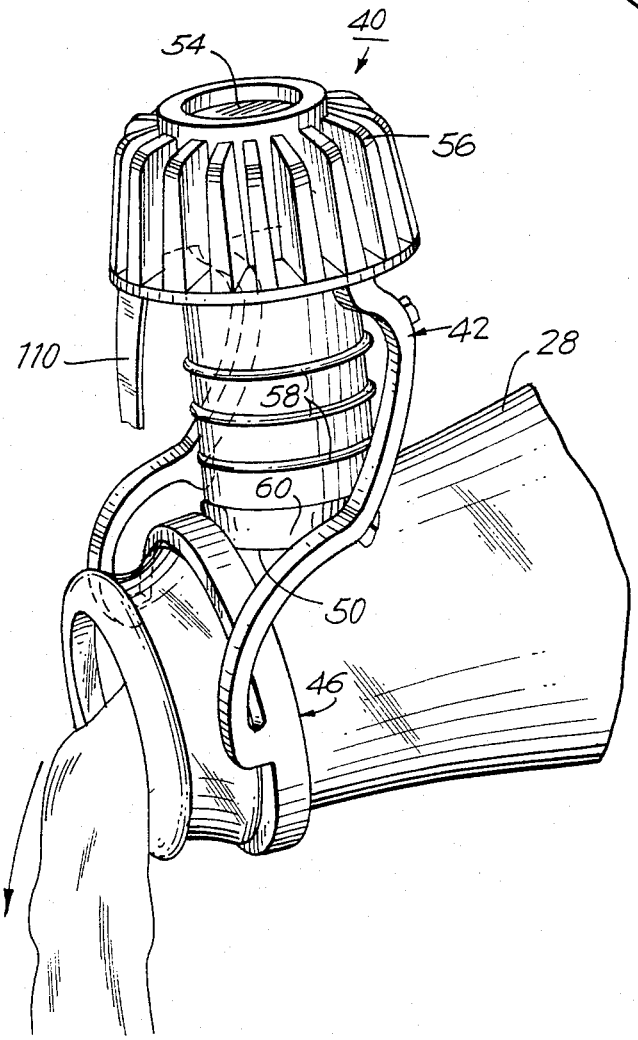
FIG. 17

BOTTLE WITH A ONE-PIECE CORKING MEANS

This application is a continuation-in-part of applications Ser. Nos. 223,894 (now abandoned) and 384,758 (now U.S. Pat. No. 4,429,799 dated Feb. 7, 1984) filed Jan. 9, 1981 and June 3, 1982, respectively, for Bottle, Method and Apparatus for Stoppering Modified Bottles With a One-Piece Corking Means.

BACKGROUND OF THE INVENTION

1. Field of the Invention

The present invention generally relates to bottles with pressurized carbonated water-based liquid contents, such as champagne and sparkling wines, having stoppers, and, more particularly, to a plastic one-piece cork unit which is anchored to the neck of a bottle by at least one pair of tethers.

2. Description of the Prior Art

It long has been recognized that bottles with pressurized, carbonated contents present a hazard. When such a bottle is opened, the stopper often will fly off so forcefully as to be capable of injuring a person nearby. Facial and eye injuries have been known to occur when a stopper is shot out of the bottle.

A number of different closure arrangements for bottles with pressurized, carbonated water-based liquid contents have been mentioned in the prior art.

Thus, U.S. Pat. No. 3,986,627 discloses a stoppering system in which a cap is attached to a securing ring on a bottle neck by a single protruding flexible member. However, the cap is not inserted into the neck of the bottle.

U.S. Pat. No. 4,054,221 discloses a device in which a cap is attached to a ring on a bottle by a single strap portion. In this patent, too, the stoppering device is not inserted into the neck of the bottle and, therefore, cannot shoot out of a bottle, even accidentally.

U.S. Pat. No. 773,345 discloses a multi-part device in which a stopper is attached to a loop around bottle neck by a single chain or wire.

U.S. Pat. No. 1,265,263 discloses a multi-part device in which a stopper is secured to a bottle by a single rope or wire.

British Pat. No. 15267 discloses a multi-part device in which a stopper is secured to a bottle by a single chain.

West German Pat. No. 2,200,857 discloses a multi-part device in which a stopper is secured to bottle neck by a separately formed single tether.

Swiss Pat. No. 338,108 discloses a bottle stoppering system in which a cap is secured to a bottle by a single tether. This stoppering system utilizes a capping, and not a stoppering, device. The tether extends horizontally outward of the outer surface of the bottle. The capping device is of a one-piece plastic construction.

Although all of foregoing closure arrangements appear to be satisfactory for their intended purposes, they have drawbacks for use in stoppering bottles with pressurized, carbonated, water-based liquid contents. Due to the existence of outwardly extending tethers on some of the prior art arrangements, the application of restraining wiring on the bottles after stoppering is difficult. For the same reason, it is difficult to pack large numbers of stoppered bottles.

In prior art arrangements that have multi-part closure portions, problems arise in assembly and inventory which add to the total cost of stoppering the bottles.

In application Ser. No. 223,894, an improved stoppering arrangement is disclosed in which a plastic stopper is connected by a single tether to a ring, the cork, the tether and the ring being molded in one piece as a unit, the ring being forced over an upper flange on the neck of a bottle near the mouth and the ring being capable of being manually forced over a second lower flange. The single tether is in a folded state, as molded, and the folded tether is so physically disposed at this time of molding that its radial position with respect to the axis of symmetry of the stopper does not extend beyond the ring prior to and after insertion of the stopper in the bottle neck. In the as-molded state of the cork, tether and ring, the single folded tether is connected to the head of the stopper and to the ring by frangible bridges so as to retain the tether in a folded state and the unit in a compact condition prior to insertion of the stopper into the bottle neck. However, these bridges break upon insertion of the stopper into the neck of the bottle and forcing of the ring over the flange on the neck of the bottle so that when the stopper is loosened prior to its extraction from the neck of the bottle, it is not free to be ejected forcefully and unrestrainedly but rather will be checked in its flight, if any, from the bottle by the tether.

An objection has been raised to the use of a single tether which is that the stopper tends be pulled back to a position where it interferes with the flow of liquid from the mouth of the bottle unless the withdrawn stopper is grasped by the user and held out of the path of the issuing stream. It was proposed to remedy this in the second application by using either a pair of tethers to connect a single point on the ring to a single point on the stopper or by using a pair of tethers to connect each of two different points on the ring to each of two different points on the head of the cork. But these, too, caused objections.

The first modification caused the same drawback as the single tether and the second modification raised the objection that the stopper tended to act as an intermittent check on the free flow of liquid from the bottle. In the earlier application Ser. No. 223,894, only the single tether form of application Ser. No. 384,758 was disclosed, with which the first above drawback was present.

There was another problem with the tethers shown in the aforesaid applications, particularly with the single tethers shown in the Ser. No. 223,894. The problem sometimes arose that the tether was not sufficiently strong to restrain the stopper, i.e. keep it from flying freely under the force engendered by the pressure of the gas in the head space of the bottle. Conventionally carbonated beverages are pressurized to maintain a certain range of pressures at ordinary room temperature, that is 20° C. Indeed, champagne usually is served chilled and, very frequently, sparkling wines are served chilled so that the pressure in the head space of the bottle is not so great that the stopper cannot be restrained by a single tether. Nevertheless, some consumers are not accustomed to drinking a champagne or sparkling wine and do not chill the beverage before serving so that such bottles may be opened, upon occasion, at room temperatures or even higher. If the tether had acquired a defect in the molding, the stopper might fly free and injure the person opening the bottle or a person nearby. Although this was a rather rare occurrence, the liability could be substantial and it was not an event which a bottler could disregard. A bottler wants to be assured that the stopper would not be freely propelled from the bottle under any circumstances.

Also there is the problem that champagne and sparkling wines sometimes will be stored in places which are not refrigerated and where temperatures may be quite high so that even if the stopper were not loosened, it might work its way partially out of the neck fo the bottle and, if the single tether were not strong enough to restrain it, it would pop out and might strike someone passing by.

Too, the wire cage or metal bail which was employed to guard against such accidental dislodgment of the stopper might have been improperly applied and since, by Murphy's Law, untoward events usually happened concurrently, the wire cage or bail might fail on the same bottle as that on which a defective tether was present.

Attempts were made to solve this problem by employing a stronger material for the tether and by increasing the cross section of the tether, but these did not prove successful because the tether became too stiff, so stiff that it would not straighten out sufficiently when the stopper had to be withdrawn to permit liquid to be poured from the bottle and the stopper then became difficult to handle.

In the later patent application, Ser. No. 384,758, two alternatives were proposed. One of these, shown in FIG. 10, was the use of four tethers arranged in two sets, each set being independent of the other and the tethers of each set connecting a single point on the head of the stopper to a single point on the ring. The other of these was shown in FIG. 11, wherein there was a single set of tethers both ends of which were connected to a single point on the stopper and to a single point on the ring. However, neither of these proved to be entirely satisfactory, although they somewhat alleviated the problem. Both of these proposals retained the stopper in position against head space pressures which were considerably elevated by higher than average temperatures but were unable automatically to enable the stopper to assume a position free of an outpouring stream when the bottle was opened.

PURPOSES OF THE INVENTION

It is an object of the present invention to provide a closure arrangement for stoppering of bottles with carbonated water-based liquid contents which is not subject to the drawbacks of prior art structures or to the above indicated objections to the earlier applications.

It is another object of the present invention to provide a safe, efficient and economical system for stoppering the aforementioned bottles.

It is another object of the present invention to provide a closure arrangement in which the stopper, when withdrawn from the neck of the bottle, easily can be kept in a balanced position away from a stream of liquid pouring from the bottle.

It is yet another object of this invention to provide a closure arrangement of the character described which consists of few parts and is easy to assemble.

Still another object of this invention is to provide a closure arrangement of the character described which allows stoppering of bottles by unskilled laborers.

Other objects of the invention in part will be obvious and in part will be pointed out hereinafter.

BRIEF DESCRIPTION OF THE INVENTION

In keeping with the foregoing objects, this invention resides in a closure arrangement for stoppering bottles with pressurized, carbonated water-based liquid contents such as champagne and sparkling wines, preferably a bottle with an elongated neck, a mouth, a body, and two axially spaced squat annular flanges on the neck adjacent to the mouth, although the invention will function satisfactorily with only one such flange.

With this bottle there is used a stopper unit which includes a stopper, twin folded tethers, and a ring, all injection molded as one piece of thermoplastic material. The ring is receivable between the two annular flanges, i.e. below the top flange of the bottle neck. The plastic is elastomeric and the ring is so dimensioned that the inner diameter thereof as-molded is slightly smaller than the outer diameter of the uppermost flange so that it can be pushed down by machine over this flange, expanding as it does so and contracting to a small diameter after it has passed the uppermost flange, whereby the ring will be anchored between the two flanges or, if only one flange is provided, it will be anchored below that flange.

If there are two flanges the lower flange preferably has a slightly larger outer diameter than the upper flange, for a reason that will be described hereinafter.

Preferably the stopper has an enlarged head to facilitate manual gripping and manipulation thereof, and the stopper is frictionally receivable in the mouth and neck of a bottle to form a tight closure therefor, which is a push fit, i.e. tight enough for the stopper to remain in the neck of the bottle and resist the internal pressure generated by the carbonated liquid contents when at ordinary room temperatures, e.g. about 20° C. However, it is usual and conventional to provide some sort of retaining arrangement such as a wire cage or a metal band in the shape of a bail to insure that the stopper will not be accidentally forced out of the bottle by gas pressure during storage, transport, or handling of the bottle, particularly if the bottle is subjected to temperatures high enough to generate an internal gas pressure that might suffice to force the stopper out of the bottle inadvertently. The shank of the stopper also includes annular ridges to increase the frictional contact between it and the inner surface of the bottle neck.

There are at least two opposed folded tethers. Each tether is connected at one end to a different point on the head of the stopper and at its other end to a different point on the ring. The points of connection of the tethers to the head of the stopper are spaced angularly apart, as are the points of connection of the other ends of the tethers to the ring. The present invention is distinguished from the invention which is disclosed in the second aforesaid application in that midpoints of the folded tethers of the present invention are adjacent to one another and are interconnected by an energy-absorbing link. More specifically, each tether is in a fully collapsed state as molded, each tether being singly folded, i.e. having two branches connected by a retroverted bend to form a narrow 'U' of which the two arms are substantially parallel as molded. The two bends face away from one another but their closed ends are near together, a typical spacing being in the order of 3/16 of an inch. The branches are arcuate in plan and are oriented with their centers of curvature coincident with the axis of uniformity of the bottle neck.

A plurality of frangible bridges may connect the two parallel arms of each folded tether to one another and/or to the head of the stopper and/or to the ring, the purpose of these bridges being to assist in holding the folded tethers in their as-molded configurations. In these as-molded configurations the radial orientations of the tethers are such that the tethers do not extend radially beyond the ring and, preferably, not beyond the radius of the head of the stopper so that when the stopper/tether/ring units are in a random mass in a hopper, they will not tend to become entangled and can be easily separated from one another in an automatic feeding device. However, these frangible bridges are readily broken when the shank of a stopper is inserted into the neck of a bottle and pushed down by machine and subsequently the ring is pushed down over an uppermost flange by machine. But such pushing actions do not suffice to break the energy-absorbing link which joins adjacent retroverted bends of opposed folded tethers and which, therefore, remains intact when a bottle and its contents appear on the shelf in the marketplace and when a stoppered full bottle is carried home by a consumer ready to be opened on some festive occasion.

Presumably, before a stopper is withdrawn from the mouth of a bottle, the bottle and its contents have been chilled so that the pressure of the gas in the head space is not excessive and the stopper can be partially or fully withdrawn with safety after the wire retention means or the bail has been removed.

However, as observed previously, not all consumers are educated in the proper handling of carbonated wines and champagnes. Some will open a full bottle while it still is at room temperature, or even higher, and it is to protect such people that the present structure has been devised. When this structure is used and the stopper is partially withdrawn, if there is a high pressure of gas within the bottle which would be sufficient to violently eject the stopper from the bottle, the stopper would be restrained by the two tethers. As pointed out previously, if there were only a single tether it might not be strong enough to prevent the stopper from flying free and this might also be true of a double or multiguard tether.

But where an energy-absorbing link connects the two retroverted bends, the force tending to eject the stopper tries to straighten out the oppositely folded tethers, both of whose ends are spaced apart from one another by distances exceeding the length of the link, and therefore tensions said link. Hence, said link absorbs the ensuing stress and may ultimately break, but before doing so it will absorb sufficient energy to prevent a stopper from flying free, and it has been found that the presence of such link has sufficed to hold the stopper captive under all conditions to which a bottle of this nature conceivably can be subjected, even upon storage for long periods at temperatures over 100° F. and even after shaking of a bottle.

By way of explanation, a brief mention here will be made of typically prevailing pressures in the headspaces of present commercial stoppered carbonated alcoholic beverage bottles.

A typical such bottle is charged with approximately 4.7 to 5.8 volumes of carbon dioxide per volume of liquid alcoholic beverage resulting in a gas pressure in the head space of a stoppered bottle of about 70 to 80 PSIG at a temperature of about 68° F. This corresponds to a pressure of about 45 PSIG at a temperature of about 40° to 45° F. When such a bottle is charged and stoppered this operation is customarily performed at a temperature of about 35° F., at which time the prevailing charging pressure is approximately 35 to 40 PSIG. The pressures just mentioned exist inside the stoppered bottle and are insufficient to forcibly eject a stopper that is firmly driven home in the neck of the bottle, although as a matter of precaution, such a stopper, by custom, is firmly held in place by the addition of a wire restraining netting, or a bail.

Of course the temperature to which a charged and filled bottle is subjected after it is shipped from the factory cannot be controlled, although the bottler may suggest a modicum of care. Such care certainly is desirable because at a temperature of about 90° F. the interior pressure in the bottle rises to about 105 PSIG, and at a temperature of about 100° F. it reaches about 110 PSIG, while at about 110° F. it becomes about 120 PSIG. At a temperature of about 120° F. the internal pressure is still higher, attaining a peak of about 130 PSIG and may go even somewhat higher with shaking to which an unwary consumer may subject a bottle, particularly if slightly intoxicated. At this stage the stopper becomes a dangerous instrument. Usually the wire restraining netting or the bail will keep the stopper in place, but when these are removed, the stopper may shoot out rapidly even without the assistance of the potential consumer and if he should start to pry the stopper loose he may not be able to control it, and it will then be ejected with great force and should it happen to be pointed at his or another's body or face, severe damage could result. It is toward the prevention of such damage that the two prior applications and the present invention are directed.

As an incidental result, in the preferred form of the present invention the tethers in their as-molded condition are so situated that they are asymetrically located with respect to the axis of symmetry, i.e. the longitudinal axis, of the neck of the bottle, so that when the stopper does spring out of the mouth of the bottle it will not tend to interfere with the free flow of the stream of liquid as it is poured from the bottle.

The novel features which are considered characteristic of the invention are set forth in the appended claims.

The invention together with additional objects and advantages thereof will best be understood from the following description of the specific embodiments when read in connection with the accompanying drawings.

BRIEF DESCRIPTION OF THE DRAWINGS

FIG. 1 is a schematic plan view of a plant in which bottles are filled and stoppered with cork units embodying the present invention;

FIG. 2 is a perspective view of a combined unitary stopper tether ring cork unit of the present invention prior to mounting on a filled bottle;

FIG. 3 is an enlarged cross-sectional view taken substantially along the line 3—3 of FIG. 2;

FIG. 4 is a sectional view taken substantially along the line 4—4 of FIG. 3;

FIG. 15 is a view similar to FIG. 12, but illustrating a cork unit in accordance with the present invention utilizing two tethers instead of the four shown in FIG. 12;

FIG. 16 is an enlarged sectional view taken substantially along the line 16—16 of FIG. 15; and FIG. 17 is a view similar to FIG. 14 of the bottle and the cork unit of FIG. 15.

DETAILED DESCRIPTION OF THE PREFERRED EMBODIMENTS OF THE INVENTION

Figure 6:
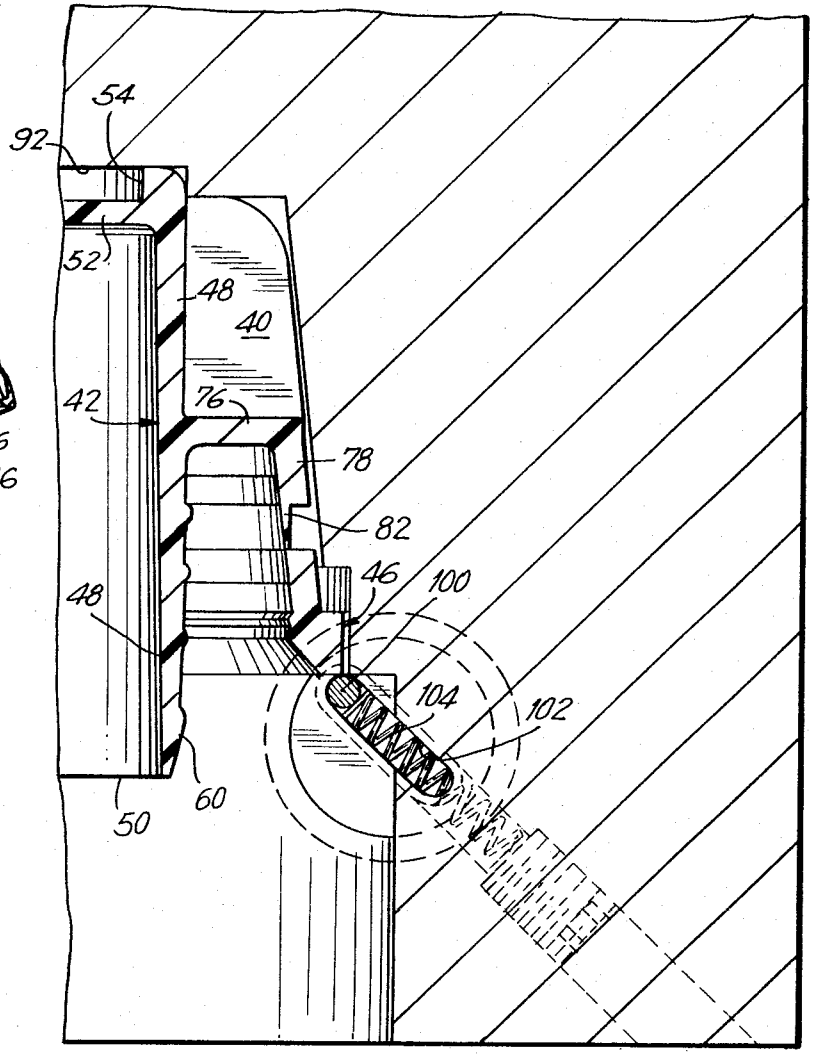
FIG. 6 is a further enlarged view of said die taken substantially along the line 6—6 of FIG. 5, the stopper/-tether/ring/cork unit, as in the case of FIG. 5, being illustrated in its position prior to insertion of the stopper into the neck of a bottle.

Referring now in detail to the drawings, and more particularly to FIG. 1, the reference numeral 20 denotes a plant for filling and stoppering bottles with liquid, specifically an aqueous carbonated liquid under pressure, a typical pressure being in the order of 70–80 PSIG at room temperature, after filling. A particular embodiment with which the invention is practiced is that of domestic, i.e. U.S., champagnes.

A typical plant 20 includes three operational stations 22, 24 and 26.

At the station 22 empty bottles 28 which previously have been cleaned and dried are fed, usually automatically, onto a rotary carrier from a line 30, the rotary carrier being denoted by the reference numeral 32. The carrier 32 intermittently advances the bottles to and past one or plural filling heads 34, e.g. nozzles, which, when the bottle or bottles are stationary, feed carbonated beverages under gravity into the bottles beneath the heads in predetermined volumes, leaving suitable headspace. The carrier 32 then shifts the filled bottles back onto the line 30 which transports them to the station 24 at which there is another intermittently rotatable carrier 36 that brings the filled bottles to and past one or plural cork unit-inserting heads 38.

A stopper/tethers/ring/cork/unit 40, such as is inserted by the head 38 into bottle after filled bottle, is shown in FIG. 2, this being a cork unit the structure of which prior to and after assembly onto a filled bottle is a feature of the present invention and will be described in considerable detail subsequently. At this point it will suffice to say that at the cork unit-inserting head 38 a shank of such a unit 40 simply is inserted into the neck of a filled bottle, but the coupling of the unit with the bottle is not as yet completed, this being left for the following station 26.

There may be several cork unit-inserting heads 38 which can, if plural such heads are provided, operate in unison each time that the rotary carrier 36 halts its intermittent rotation.

It may be observed that when wine is fed into the bottles it possesses natural carbonation by virtue of preceding and ongoing fermentation, which is maintained by keeping the wine chilled, and the wine is kept chilled as it is introduced into the bottles, through the filling station, on the line between the stations 22 and 24, and through the station 24, up to the time that filled bottles are corked. Thereafter, escape of carbonation is prevented by the cork units so that the wine remains carbonated at a desired pressure of approximately 70–80 PSIG during the remainder of the handling in the plant 20, during storage at ambient temperatures and in a consumer's household at room temperatures in the vicinity of 68° F.

After filling at the station 24, the corked bottles are discharged back onto the line 30 which carries them to the station 26 where the cork unit is further coupled to its associated bottle by a ring/flange connection which will be detailed at a following point of this description. The purpose of this ring/flange interengagement is to captively tether the cork unit to the bottle so that when, at a subsequent point in time and place, a user starts to pull the cork unit out of the neck of the bottle and when circumstances might combine to cause the stopper to shoot out of the neck of the bottle and harm the user or someone nearby, the safety feature provided by the tether, the ring, and the bottle flange prevents this from happening.

After the aforesaid coupling has been effected, the bottles are delivered back onto the line 30 for further handling which will usually constitute the application of a wire restraint cage or bail over the cork unit as a precautionary measure and, frequently, the wrapping of decorative foil and labelling for esthetic and commercial purposes.

The particular operational means for actuating the mechanisms at the stations 22, 24 and 26 and for actuating the line 30 are conventional and form no part of the present invention so that they will not be detailed herein. Nor is the mechanism for filling the bottles relevant to the present invention and therefore it is not described. However, the mechanism for inserting the cork units in the necks of the bottles, for feeding such units into the feed chutes and for driving the rings over the upper flanges of the bottles do form part of the instant invention and will be detailed subsequently along with references to figures. At this point, however, a description of their operation is not necessary. Nevertheless, it is believed proper here to interrupt the description of the different parts of the plant 20 with a detailed description of the cork unit 40 and for this purpose reference is directed to FIGS. 2 through 4 in particular.

The cork unit 40 is a composite, that is to say a unit composed of several parts which are molded of a plastic, usually an elastomeric thermoplastic material, as a single piece, the unit being illustrated in FIGS. 2, 3 and 4 in its as-molded condition. At this time the unit 40 includes three essential components which are:

A. A cork 42 usually referred to as a "stopper";

B. A tether(s) 44; and

C. A ring 46.

Although it has been so stated above, it is to be emphasized that the stopper, the tether(s) and the ring are molded in one piece from plastic, that is to say that they are a one piece unit and that they occupy the relative position which are clearly illustrated in FIGS. 3 and 4 and will now be described in some detail.

The stopper 42 is a tubular cylindrical sleeve 48 which is open at its lower end 50 as a matter of molding convenience and includes a crown 52 which provides a closed upper end to maintain the requisite carbonation pressure within a stoppered bottle. A suitable material for the unit 40 is an injection molded elastomeric thermoplastic such as polyethylene.

The crown may be formed with a shallow recess 54 to receive a manufacturer's or a product identification label (not shown).

To facilitate grasping of the stopper the stopper head is enlarged by the inclusion of radially extending circumferentially spaced ribs 56 which provide a good grip to be engaged by a user's hands when it is desired to rotate and pull the stopper from the neck of a bottle in which it is inserted.

The lower external surface of the sleeve 48 has molded thereon a series, e.g. four, spaced squat annular rings 58, that insure tight frictional engagement of the sleeve with the inner surface of the neck of the bottle, bearing in mind that the molding tolerances for glass bottles are not particularly close, nor is the molding tolerance for injection molded plastic parts. However, because the sleeve is elastomeric and because the rings 58 are of slight axial length and radial height, the sleeve is able to be radially compressed with comparative ease to tolerate dimensional variances in molding and still obtain a good frictional fit between the stopper sleeve and the bottle neck sufficient to enable the stopper to be held firmly in place against the gas pressure in the bottle once the stopper has been pushed tightly into the bottle neck. Desirably, the lower end of the stopper 42 is chamfered, as at 60, to ease its entry into the mouth of a bottle.

Considering now the tether 44, this has been described in the singular, i.e. as "a" tether, in actuality, in the cork unit 40 shown in FIGS. 2 through 4 now being described there are four tethers 62, 64, 66 and 68. These tethers are arranged in pairs, which is to say the tethers 62 and 64 form one pair which mutually act conjointly and the tethers 66 and 68 form another pair which mutually act conjointly. More particularly, the tether 62 (see FIG. 2) is in the shape of a narrow "U" with a retroverted bend 70 and two parallel branches 72 and 74.

Considering just this tether 62 in plan, it is of arcuate configuration and it is approximately in registry with the outer ends of the ribs 56 of the head of the sleeve 48. The lower ends of the sleeve ribs 56 terminate at a circular disk 76 whose radius equals that of the lower ends of said ribs and the outer sides of the arcuate tether 62 are approximately in vertical registry with the associated portion of the overlying part of this disk (see FIG. 3). Phrased somewhat differently, the tether 62 in its as-molded condition does not extend radially beyond the head of the stopper. Actually, it is positioned at just about the outer radial boundary of the head of the stopper. The same holds true of all of the tethers 62, 64, 66 and 68; that is to say, they all are arcuate and all are in approximate registry with their associated portions of the overlying parts of the disk 76.

The upper ends of the tethers 62, 64, the inner faces of the retroverted bends 70 of which face each other, although spaced apart, merge together at a common zone 78 and this common zone is joined to (runs into) the undersurface of the disk 76 adjacent the latter's periphery. The lower ends of these same tethers 62, 64 merge into another common zone 80 which is unitary with the ring 46 mentioned earlier.

The ring 46 is arranged concentrically with the sleeve 48, concentrically with the disk 76 and concentrically with the arcuate tethers 62, 64, 66, 68. However the ring 46 is located below, specifically a short distance below, the lower branches 74 of the tethers 62, 64, 66, 68. This spacing is quite clearly shown in FIGS. 2, 3 and 4.

Common zones such as those 78, 80 mentioned with respect to the tethers 62, 64 also are provided for the tethers 66, 68. The common zones 78, 80 for the tethers 62, 64 are substantially diametrically opposed (on the disk 76 and the ring 46) with respect to the common zones for the tethers 66, 68 on the disk 76 and the ring 46 so that the ring and the head 38 of the cork are in effect connected by four tethers arranged in two pairs, each pair having a common upper end at the head of the stopper and a common lower end at the ring, these ends being spaced substantially 180° apart at the head of the stopper and at the ring. This 180° spacing is not essential but does provide a neat symmetrical appearance and encourages uniform flow of molten thermoplastic during a molding cycle.

It is to be emphasized that the above described positions of the tethers refer to their as-molded positions and these are positions the tethers will occupy as the units 40 are handled prior to coupling with bottles. There will be displacements from these positions as will be pointed out subsequently when the sleeves 48 are inserted in bottles and there will be a further change when the stopper 42 is removed from a bottle by a user. All of this remains for later description.

To maintain the various components of the cork unit 40 as a compact coherent one-piece unit for convenient handling and for ready segregation from a random mass thereof in a hopper, frangible bridges are employed to aid in holding the tethers 62, 64, 66, 68 in their as-molded folded arcuate positions within the confines of an imaginery cone extending from the periphery of the disk 76 to the periphery of the ring 46, this being the positions that they occupy at the time of their molding.

The frangible bridges may include bridges 82 (see FIGS. 2 and 4) spanning the narrow gap between the center points of the folded pairs of tethers 62, 64 and 66, 68. These bridges are sufficiently strong to withstand the minor stresses imposed thereon during handling of the cork units 40 but not to withstand any substantial tensile force urging apart the head 38 and the ring 46.

The common zones 78, 80 also act to anchor the centers of the tethers in their as-molded positions but do not function to control the positions of the intermediate portions of the tethers when the tethers are stretched, an action to which it will be seen they are subjected during certain steps of the coupling operation and during uncorking of a bottle.

If desired, additional bridges, which are not employed in the cork unit 40 here illustrated and described, may be employed to interconnect the branches of the sundry tethers either to the undersurface of the overlying disk 76 or to the other tether of the same set as the tether the retroverted bend of which has its rear surface facing the retroverted bend of the first tether of the same set and this second tether of the set likewise runs from a point on a disk to a point on the ring. Again the two points preferably lie in a common axial plane. If there are two sets of tethers in a cork unit 40, as is the case with the unit 40 shown in FIGS. 2–4 there is a common point for one tether of each set on the disk, this being the point 78 and a common point for the other tether of each set on the ring, this being the point 80.

As will be described in connection with a modified form of the invention shown in FIGS. 15 through 17 only one "set" of tethers may be employed and, indeed, this currently is the preferred form of the invention, i.e. the form in which only one set of tethers is used.

Although the frangible bridges, e.g. the bridges 82, are intended to break with comparative ease during coupling of a cork unit 40 to the mouth of a bottle, at which time tensile forces tend to move the ring further apart from the head 38 of the cork unit, the energy-absorbing links 84 are sturdier than the frangible bridges. They are sufficiently sturdy so that when a tensile force is exerted on a cork unit tending to spread apart the head 38 from the ring 46 and thereby somewhat to straighten out the tethers of a "set" the links 84 will not rupture. They are strong enough to resist the engendered tensile force. Such force is, however, applied to the energy absorbing links tend to and actually do stretch the same and in so doing some of the energy which moves the head apart from the ring.

Thus, after a cork unit 40 is finally coupled firmly into the neck of a bottle, the ring below the energy absorbing links 84 will be intact, as will the tethers and the energy-absorbing links, although the frangible bridges will be broken. When, thereafter, a stopper 42 is pried and/or twisted loose from the neck of a bottle and finally reaches the point when the gas in the head space of the bottle is sufficient to overcome the friction retaining the stopper in the bottle neck so as to shoot the stopper out of the bottle neck and, in so doing straighten out the tethers, this action will place tensile stress on the energy-absorbing link 84. Stress is absorbed by the link to lengthen the same and, in so doing, lessens the force propelling the stopper outwardly. Ultimately the links 84 may break, depending upon the pressure of the gas in the head space of the bottle. But by the time the energy-absorbing links have reached their bursting points the acceleration of the stopper will have been sufficiently retarded so that the stopper will be checked in its flight by the tethers and will not fly freely to strike and damage nearby people.

Polyethelene lends itself to injection molding of complex shapes such as that of the aforesaid cork 40. A grade of polyethelene which works well for accomplishing the present invention is a linear low density polyethylene sold by the Dow Chemical Corporation under the trademark, Dowlex 2535 resin for injection molding—LLDPE. This resin has the following typifying characteristics:

Melt Index: 6.0
Density: 0.919
Tensile Yield Point: 1,665 psi
Elongation: 800%
Flexural Modulus: 2% secant; 38,000 psi
Izod Impact Strength: 1.25 ft.lb./sq.in. of
Tensile Impact: 70 ft.lb./sq.in.

This material complies with FDA Reg. 117.1520 when used and modified in accordance with good manufacturing practice for food contact applications.

In the earlier applications, the tethers were of polyethylene and had cross-sectional areas of rectangular configuration measuring approximately 0.075 inches by 0.09 inches but these tethers occasionally broke when the pressure in the head space became unduly high, for example 130 PSIG or higher, because of high ambient temperatures or because of shaking of the bottle. Efforts were made to overcome this difficulty. At one time it was proposed to use a less flexible plastic or to use tethers of larger cross-sections but this did not provide satisfactory results because such tethers did not flex sufficiently readily when the stopper was pulled or the extracted stopper sometimes interfered with flow of liquid from the bottle. These difficulties have been avoided by use of the present cork unit 40 in which the aforesaid elastomeric plastic is employed and in which the cross-sections of the tethers are approximately 0.07 inches by 0.07 inches, a preferred dimension being 0.072 inches by 0.072 inches. A suitable and satisfactory length for each of the two tethers of a set, when a tether is fully straightened out, is, by way of example, $1\frac{5}{8}$ inches, to permit the stopper to be pulled out sufficiently and to assume an out-of-the way position as shown, for example, in FIG. 14. It also has been proposed to use two sets of tethers as shown in FIGS. 2 through 4. However, one set of tethers will suffice as shown in FIGS. 15 through 17 and, indeed, is preferred.

Further, by way of example, and in order to better describe the apparatus of the present invention it should be mentioned that energy-absorbing links 84 with two sets of tethers or even a single set of tethers such as described above, can be used which have a rectangular section of 0.048 inches by 0.060 inches with a space between the near surface of the bases of the retroverted oppositely facing bends, of 0.1875 inches. An energy-absorbing link 84 of the aforesaid plastic and the aforesaid dimensions has been found unfailingly to assimilate the shock of a rapidly propelled stopper issuing from the mouth of a champagne bottle, even one with an abnormally high head pressure of as much as 140 PSIG without permitting the stopper to fly free. Upon occasion the ejection speed will be sufficient to rupture the link 84, but there will not be sufficient remaining impetus to fly free and strike a bystander smartly enough to impart harm.

The frangible bridges, such as the bridges 82, are by way of example, of oblong cross section 0.08 inches by 0.015 inches. These are sufficiently thin to rupture when, as later will be described, the stopper 42 has been fully inserted into the neck of a bottle and, subsequently, the ring 46 is pushed down over the uppermost flange of the bottle. In passing, it should be noted that at this time the zones 78, 80 will not be ruptured. Indeed, these zones will not be ruptured even when the stopper is withdrawn from the neck of the bottle and is propelled therefrom.

Attention is also drawn to the dimensions and configurations of the stopper 42, but before that it should be mentioned that the stopper is intended to be received in the neck of a domestic champagne bottle which is of more or less a standard configuration but which will be described here for the purpose of completeness. The cork unit is designed to be received in the elongated neck of two different sizes of wine bottles, one having a capacity of 750 milliliters and the other having a capacity of 1500 milliliters. For the sake of economy in the production of the cork unit and of the bottles, the elongated necks of both of these bottles are substantially identical.

Aside from the upper and lower flanges which have already been described, the opening of the mouth of a bottle is internally upwardly flaring and generously rounded to permit facile introduction of the lower end of the sleeve 48. At about 0.20 inches down from the mouth of the neck the inner diameter of the neck is approximately 0.64 to 0.67 inches. This diameter is maintained for approximately 0.60 inches from the top of the mouth of the bottle. This more or less cylindrical portion of the inner surface of the neck of the bottle is suitable to receive the slightly downwardly tapering configuration of the sleeve 48 and to frictionally engage the same portion at the rings 58. The frictional fit between the ringed sleeve and the inner surface of the cylindrical portion of the bottle neck is sufficiently tight to retain the sleeve in position against fairly substantial internal gas pressures in the head space of the bottle, a task which is assisted by the presence of a retention cage or bail.

Returning now to the description of the stopper 42, the length of the stopper from the crown 52 down is about 0.945 inches. The stopper must make a tight frictional fit with the internal surface of the neck of the bottle in order to maintain a substantial gas pressure in the head space of the bottle. On the other hand, if the entire surface of the stopper which is engaged with the internal surface of the neck of the bottle makes such a tight frictional fit it would be extremely difficult to withdraw the stopper to gain access to the contents of the bottle. As a compromise, the stopper is provided with the several, e.g. four, annular squat rings 58 which are of downwardly progressively lesser radial heights, that is to say the top ring 58 projects radially the furthest from the external surface of the stopper and as the rings are located lower and lower on the stopper their radial height becomes less and less. Specifically, by way of example, the uppermost ring projects radially from the surface of the stopper approximately 0.016 inch. The next lower ring projects radially about 0.014 inch. The third ring down projects radially about 0.012 inch and the fourth ring projects a radial distance of about 0.010 inch. The fourth ring is the apex of a downwardly tapering cone which acts as an introductory pilot to guide the stopper into the mouth of the bottle at the time the stopper is inserted in the bottle. Because the stopper is quite a tight fit into the neck of the bottle, the stopper is constricted as it is introduced into the bottle; the stopper, therefore, has to constrict inwardly in a radial direction and for this purpose is made thin enough, a typical radial thickness being 1/16 of an inch.

Furthermore, it should be pointed out that the uppermost ring of is approximately $\frac{1}{4}$ of an inch below the disk 76 to enable the upper ring to engage the upper constricted portion of the interior of the neck of the bottle, and that the rings 58 are spaced about $\frac{1}{8}$ of an inch apart axially so that all the rings will engage the narrow part of the interior of the bottle.

From the foregoing description of the cork unit 40 it will be seen that the unit is very compact in its as-molded state prior to assembly with a bottle. It has no loop-like protruberances or spurs which would tend to become entangled with portions of other like units and hence units in a randomly oriented mass will not become entangled with one another so that individual units easily can be segregated from such a mass in a vibrating hopper. Moreover, the unit although symmetrical about the longitudinal axis of the sleeve 48 is asymmetrical in elevation or, in other words, has a configuration such that its shape at the top is different from its shape at the bottom. As can be seen, for example, from inspection of FIGS. 2, 3 and 4, the major portion of the height of the unit is in the surface configuration of a frustum of a cone with the narrow end up and the broad end down and the bottom of the unit has the lower end of the sleeve 48 projecting slightly therefrom.

The tethers are neatly tucked in between the disk 78 and the ring 46. The tethers are held in place prior to assembly on a bottle by the zones 78, 80, the bridges 82 and the links 84, so that the unit readily lends itself to withdrawal of single units seriatim in predetermined orientation ready for insertion, with the projecting end of the sleeve lowermost, into the mouth of a bottle.

Figure 5:
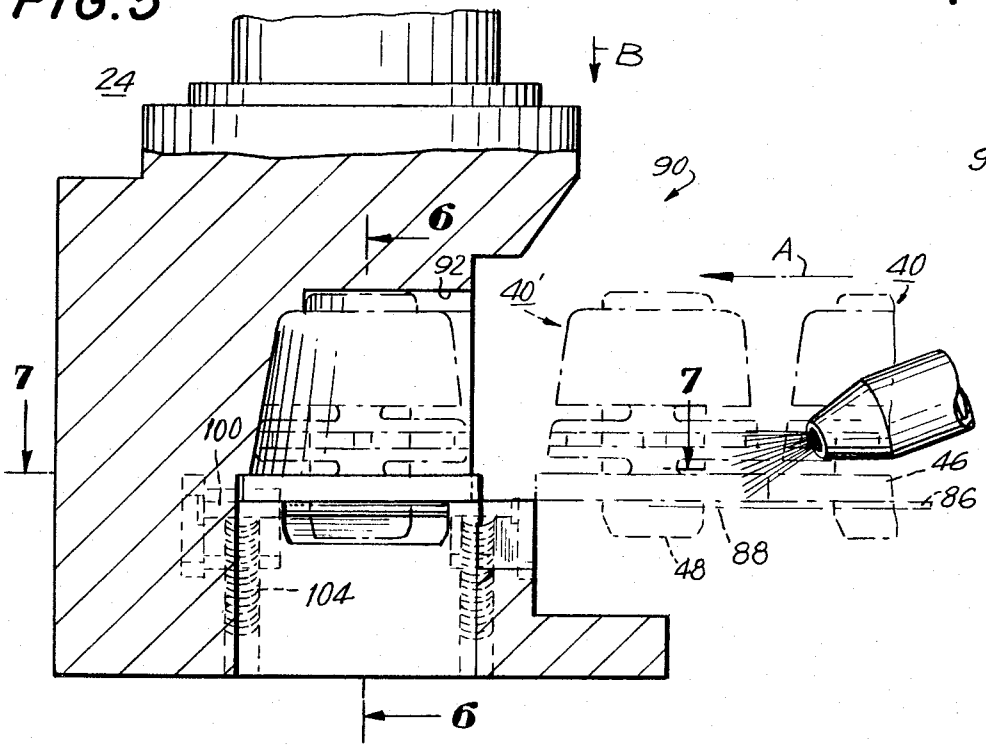
FIG. 5 is an enlarged sectional view taken substantially along the line 5—5 of FIG. 1 and illustrates the die for receiving a stopper/tethers/ring/cork unit prior to forcing the stopper into the neck of a filled bottle, the die being a reciprocating die and being shown in its upper position apart from an anvil which is beneath it and which is not illustrated, the anvil being one on which a filled unstoppered bottle, to be stoppered, is placed.

The particular structure of the hopper and outfeeding device used and the devices for eliminating improperly oriented units in the outfeeding device are will-known in the art and, therefore, have not been shown or discussed and at this point it would suffice to say that stopper units 40 arranged one after another in series are withdrawn from a hopper (not shown) associated with the station 24 and the stoppering head 38 and fed to a chute 86 (see FIGS. 1 and 5) with their projecting lower ends lowermost and extending downwardly between the rails of the chute as clearly indicated in FIG. 5. Opposed diametric portions of the lower surface of the ring 46 ride on the upper surfaces of the chute as likewise indicated in FIG. 5. The chute is inclined downwardly from the hopper except for its terminal portion 88 immediately adjacent to the stoppering head 38. At this time the units are biased to be fed in the direction of the arrow "A" shown in FIG. 5 by the force of gravity acting on the cork units 40 in the inclined portion of the chute immediately preceding the terminal portion. The foremost cork unit at the terminal portion 88 of the chute has its advance movement checked by a cork unit 40' (FIG. 5) short of a die nest 90 mounted for vertical reciprocation as indicated by the arrow "B" (FIG. 5).

Figure 7:
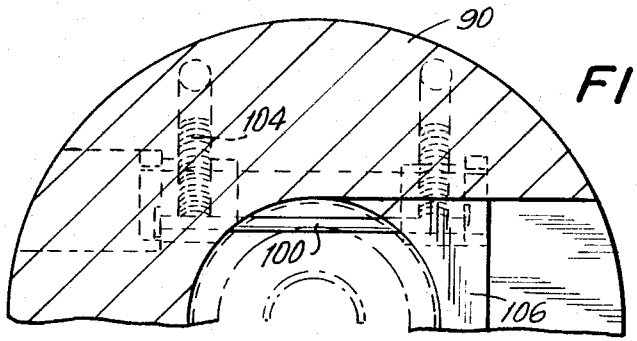
FIG. 7 is a view taken substantially along the line 7—7 of FIG. 5.
Figure 13:
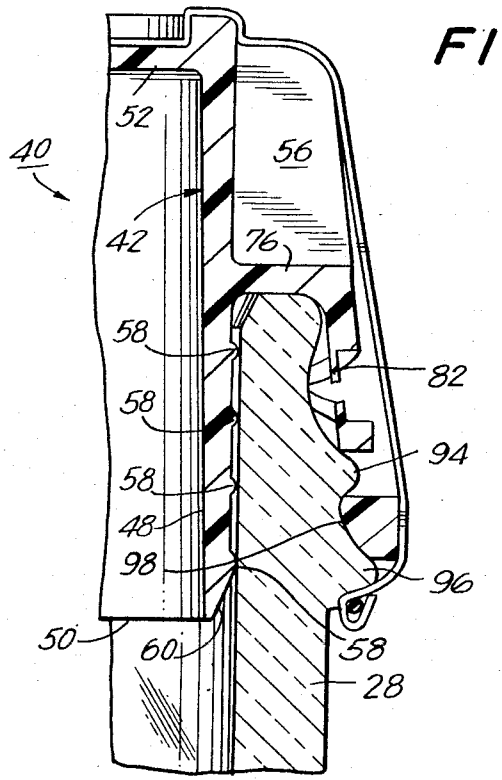
FIG. 13 is an enlarged sectional view taken substantially along the line of 13—13 of FIG. 12.

The die nest is shown in its uppermost position in FIGS. 5, 6 and 7. The die nest is located above any one of a circular series of anvils (not shown) disposed on a carrier 32 which are intermittently stationed below and in registry with said die nest. That is to say, the carrier 32 brings anvil after anvil, on each of which there is an erect filled bottle with an open mouth, directly below and centered with the die nest 90 and momentarily holds the same stationary thereat.

Figure 8:
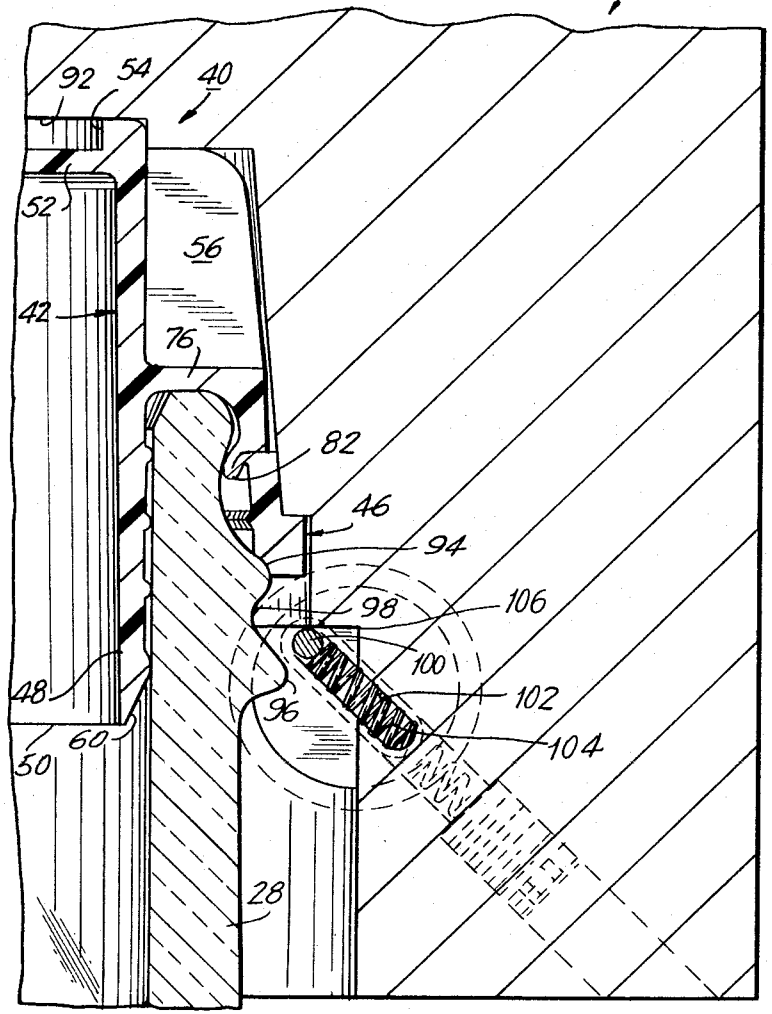
FIG. 8 is a view similar to FIG. 6, but showing the die and cork unit after the anvil, having emplaced thereon a filled bottle, has been raised, together with the die and cork unit and after the stopper has been forced into the neck of the bottle and, furthermore, after the ring of the cork unit has been machine-driven down only part way over the upper flange of the bottle, attention being drawn to the folded condition of the frangible bridge which joins the two branches of the illustrated tethers.

While the carrier 32 and anvils remain stationary the die nest 90 descends and forces the stopper unit 40 down onto the neck of the bottle beneath it as shown in FIG. 8. The cavity 92 in the die nest presses against the upper end of the sleeve 48 to urge the sleeve down as aforesaid and in so doing the ring 46 will ride onto but not down over the uppermost flange 94 of the two flanges 94, 96 on the neck of the bottle.

It is appropriate to observe at this time that in accordance with a feature of the present invention the external diameter of the upper flange 94 is slightly larger than the internal diameter of the ring 46 but is smaller than the external diameter of the lower flange 96. The reason for this should be explained. It is desired to have the ring 46 captively held on the neck of the bottle between the two flanges 94 and 96 because the ring serves as an anchor for the lower ends of the tethers which captively retain the cork and prevent it from flying free. It is quite apparent that if the ring were not held firmly in place there would be nothing to prevent the cork from being propelled from the bottle under certain circumstances and the basic function of the cork then would be lost. By having the ring slightly smaller in its internal diameter than the external diameter of the upper flange, the ring has to be expanded to be forced past the upper flange 94. Indeed, the extent of the expansion is such that the ring cannot be pushed up past the upper flange by hand but needs to be pushed thus by machine. As exemplificative of the relative diameters, a typical dimension for the inside diameter of the ring 46 as-molded is 1.221 inches and a typical dimension for the outside diameter of the upper flange is 1.327 inches. It is with these two dimensions that an elastomeric polyethylene ring cannot pushed down by hand over the upper flange but can be pushed down over the upper flange by machine.

Moreover, it is highly desirable that once the ring is pushed down over the upper flange it should not be easily pushed back over the upper flange by hand. One way to prevent this from happening is by proper relative dimensioning of the inside diameter of the upper ring and the outside diameter of the upper flange and the diameters just mentioned are quite appropriate for this purpose. Nevertheless, it is best to guard against inadvertent happenings such as someone being able by some means or other to force the ring back up over the upper flange either by the use of brute force in the case of an extremely powerful but not very bright individual, or by the use of some instrument. To assist in preventing this untoward happening, it is preferable to maintain a close axial spacing between the two flanges. A typical close axial spacing is a crest-to-crest spacing between the two flanges in the order of $\frac{1}{4}$ to $\frac{1}{2}$ inch. The minimum spacing just indicated is a fairly critical one. The maximum spacing given is representative and can be somewhat exceeded if the axial dimension (height) of the ring is increased, but this will not be usual because there is no constructive purpose served by adding to the amount of plastic incorporated in the ring. The foregoing construction means that, unlike the relative flange dimensioning discussed in earlier applications Ser. Nos. 223,894 and 384,758, where the lower flange was of lesser diameter than the upper flange in order to permit it to be manually pushed down over the lower flange, the lower flange now is of greater external diameter than the upper flange, the previously mentioned advantage of the smaller lower flange being eliminated in favor of the greater advantage of absolutely preventing removal of the ring from the bottle neck.

Because at the stopper applying station 24 the cork units 40 simply are inserted into the necks of filled bottles (having a gaseous head space) but are not further thrust down, the ring 46 of each unit stops in its descent when it encounters the outward slope of the uppermost flange 94 so that the frangible bridge 82 between said ring and the disk 76 collapses as is quite clearly shown in FIG. 8. It should be observed that downward machine pressure is applied to the head 38 of the sleeve 42 so that downward descent of the sleeve is halted when the disc 76 strikes the mouth of the neck of the bottle. However, the skirt of the cork unit which is composed of the tethers, bridges and ring is not a rigid structure, rather it is axially collapsible and does collapse when the ring strikes the uppermost flange 94 whereby to prevent further downward movement of the ring at this time.

When a corking unit enters the die nest 90 the lower surface of the ring 46 will ride on a pair of pins 100 which support the same as the ring and corking unit rest in stationary position above the neck of a bottle to be stoppered such position being illustrated in FIG. 5 and FIG 6. Were it not for these pins the cork unit simply would fall downwardly out of the die nest. Subsequently, the die nest is lowered to bring the lower end of the sleeve 48 into the open upper end of the elongated neck portion of the bottle beneath it and forces it into said neck until it has entered just above the sleeve for full frictional engagement with the inner surface of the neck up to the point that the undersurface of the disc 76 strikes the upper surface of the mouth of the bottle as shown in FIG. 8. At this moment in the stoppering cycle the elevation of the bottle is such that the lower surface of the ring has been lifted off the transverse pins which no longer are needed to support the cork unit since the bottle itself is providing this function.

Figure 9:
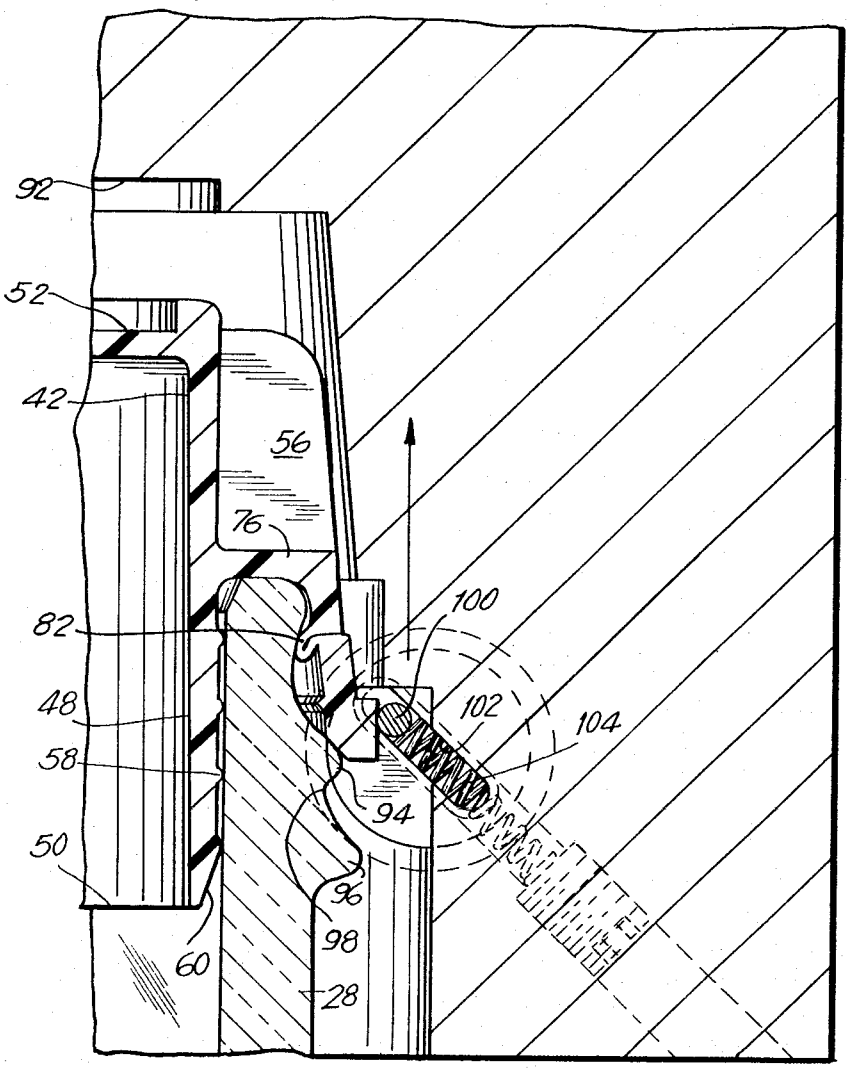
FIG. 9 is a view similar to FIG. 8, but showing the cork unit, die and bottle after the anvil together with the bottle carried thereby and the cork unit partially assembled thereon have been lowered somewhat pulling the cork unit partially out of the die, the frangible bridge still remaining in folded condition.

Next, with the die nest remaining stationary, the anvil drops somewhat to the position shown in FIG. 9. This results in the ring pushing down the transverse pins 100 until the pins separate far enough to allow the ring to descend between them so that they no longer prevent the ring from moving down. Now the die nest can be raised up after which the pins will snap back to their original position as shown in FIG. 6. It will be observed that the rings ride in inclined slots 102 and are biased upwardly by helical compression springs 104 to their idle ring supporting position, all as clearly shown in FIGS. 5, 6, 7, 8 and 9.

Figure 11:
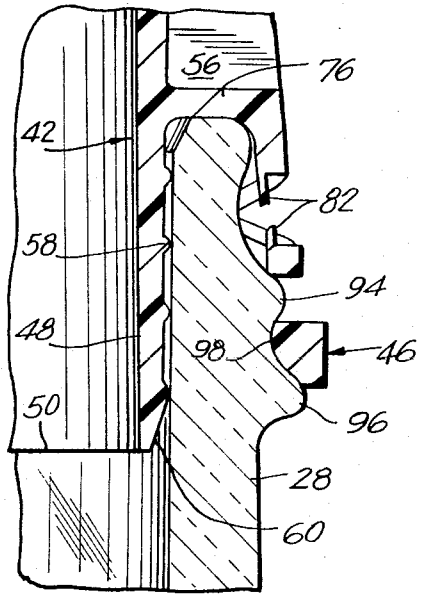
FIG. 11 is a further enlarged sectional view taken substantially along the line 11—11 of FIG. 10.
Figure 10:
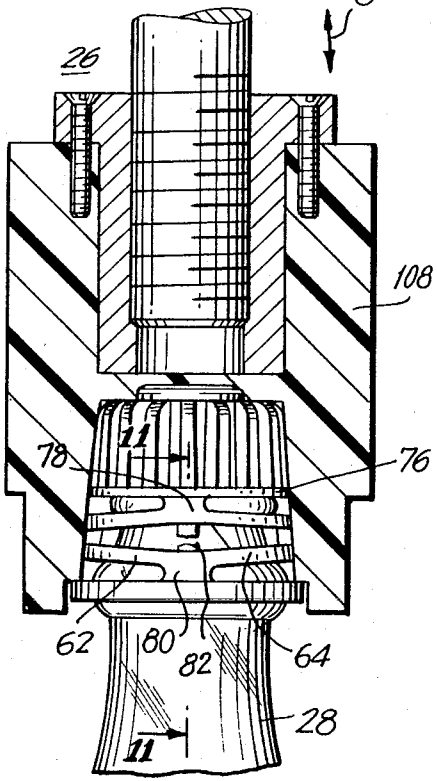
FIG. 10 is an enlarged axial sectional view taken substantially along the line 10—10 of FIG. 1, and illustrates the die used to drive the ring down over the top flange of the bottle after the stopper previously has been fully driven into the neck of the bottle.

No further action occurs at the unit inserting station 24 and the die nest 90 now lifts and the stoppered bottle proceeds onward intermittently on the carrier and eventually reaches the next station 26 where the cork unit is firmly coupled to the bottle by forcing the ring 46 downwardly to a further extent such that it will expand to pass over the uppermost flange 44, pass down over said flange and reach the valley 98 between the two flanges where it will constrict to be captively retained between said flanges. A die nest for performing this function is illustrated in FIGS. 10 and 11 where it is referenced by the numeral 108, being shown there in its lowermost position. Said die nest reciprocates vertically as indicated by the reference arrow "C". The cavity in the die nest is shaped to strike the annular upper surface of the ring 46 and drive it down further over the uppermost flange 94, cammingly expanding the ring as it does so and permitting the flange to constrict into the valley 98 where, as noted above, it will be captively retained.

The extent of downward movement of the ring 46 is sufficiently great to stretch the frangible bridges 82 enough to burst them as indicated in FIGS. 10 and 11. Because they separate the two reaches of one set of tethers as well as the other opposed reaches of the other set of tethers, if there should be one, and, if there are additional frangible bridges connecting the branches of the tethers to one another or to the ring 46 or to the disk 78, they will likewise be broken. However, the zones 78, 80 which connect the ends of the tethers to the ring 46 and to the disk 76 are sufficiently strong not to be frangible and will not be broken by the further downward movement of the ring 46 in the station 26.

Figure 12:
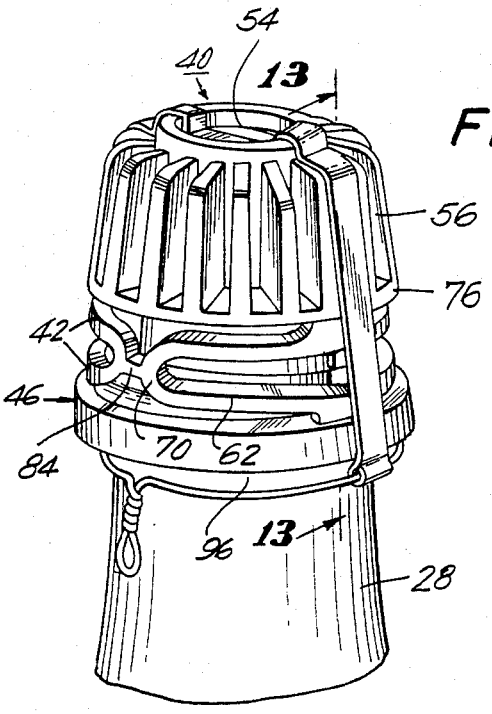
FIG. 12 is an enlarged perspective view of the top of bottle stoppered in accordance with the present invention.

The die nest 108 does not drive the cork unit 40 any further into the bottle, although, if desired, it may impart a light tap to the upper surfae of the sleeve 48. At this stage corking of the bottle is completed. However, pursuant to custom, further steps usually are carried out. One of these is the optional provision of a conventional retention means. One such retention means is, in effect, a wire net which constitutes one or a few strands of wire wrapped around and down over the corking unit to hold the same in place on the neck of the bottle against forces that might accidentally dislodge it. Another such retention means is the bail strap illustrated in FIG. 12 which is a narrow flat malleable metal band in the approximate shape of an inverted "U" which is put over the cork means after it has been placed on a bottle with the base of the "U" over the top of the cork unit and the tops of the legs of the "U" bent over the ring 46 at diametrically opposite points, the legs of the "U" then being secured in place by a wire tie which is pinched on the ends of both legs by having its ends twisted together.

Both the net and the bail are entirely conventional and form no part of the present invention. Furthermore, as is customary, the applied cork unit and retention means may be covered by a bright foil wrapping for decorative purposes and to indicate that the corking and retention means, if the foil wrapping has not been removed, have not been tampered with.

Figure 14:
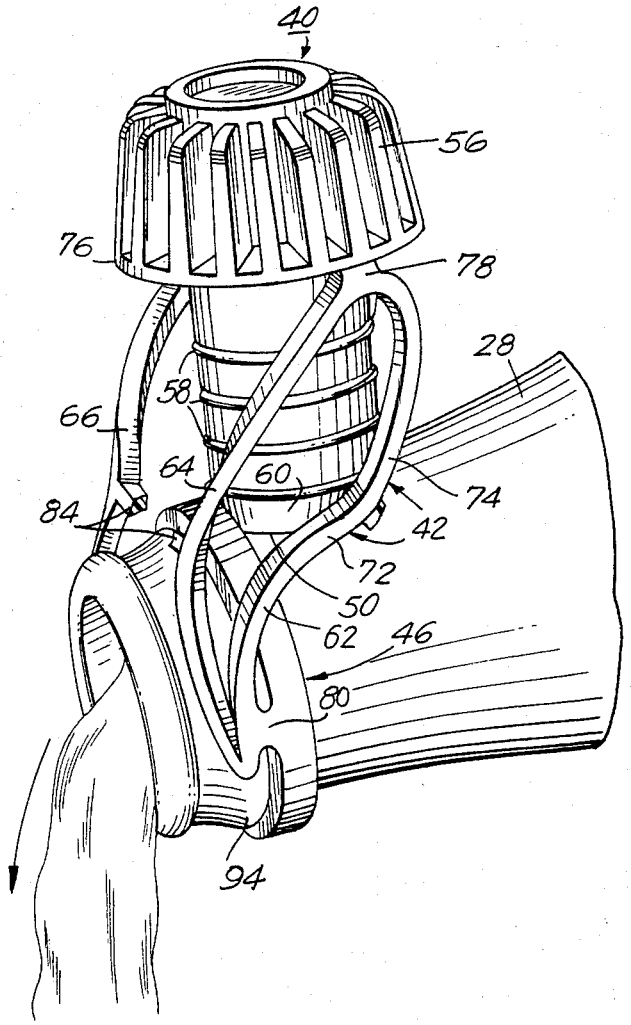
FIG. 14 is a perspective view of a bottle top embodying the present invention but in which the stopper has been pulled out of the bottle neck, the bottle has been tilted to permit an outflow of contained liquid and the stopper has been moved to an out of the way position to prevent interference with the stream of issuing liquid.

FIG. 14 illustrates the position of the corking means of the present invention after the retention means has been removed and the sleeve 48 pulled out of the neck of the bottle. When the sleeve is extracted the two sets of tethers will be partially straightened out to permit the ends of the tethers attached to the disk 76 to be pulled away from the mouth of the bottle. When this occurs the energy-absorbing links will be tensioned. If the tensioning is sufficiently great, as may or may not be the case, the links will break as indicated in FIG. 14. When opening the bottle, if the pressure in the head space is quite considerable, enough for the stopper to start to shoot out of the bottle without the user's control, the force tending to propel the stopper will be at least partially absorbed by the energy-absorbing links. If the force absorbed is sufficiently great it will rupture the links. Whether the links are ruptured or not the sleeve can be displaced to one side as shown in FIG. 14 where the formerly lower end of the stopper rests against the side of the bottle below the lowermost flange on the neck out of the way of the stream of fluid issuing from the mouth of the bottle. There is usually no tendency with the construction described thus far for the removed stopper, even though still attached to the ring, to interfere with outflow of liquid from the bottle.

FIGS. 15 through 17 show a bottle and stopper unit which are essentially identical to those shown in the preceding FIGS. except that only one set of tethers is employed. In lieu of the other set of tethers, a frangible bridge 110 is supplied which is diametrically opposed to this set of tethers and ruptures when the ring is depressed at the station 26. In this form of the invention the tethers are asymetric and there is even less tendency for the removed sleeve to interfere with the outflowing stream of liquid from the bottle.

It will be understood that each of the elements described above, or two or more together, may also find a useful application in other types of constructions differing from the types described above.

While the invention has been illustrated and described as embodied in corks units secured to bottles by tethers for bottles having pressurized liquid contents, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. For use with a bottle containing pressurized, carbonated, water-based, liquid contents and having: a body portion; an elongated neck portion; and a mouth portion, said neck portion having at least one circumferential squat, annular flange adjacent to the mouth portion;

a corking unit of a molded one-piece elastomeric plastic construction, said corking unit comprising:

(a) an elongated, generally circular, cylindrical sleeve, insertable with frictional engagement through the mouth portion into the neck portion of the bottle;

(b) a head connected to the sleeve;

(c) an annular, circumferential ring, shaped for reception on the neck portion of the bottle above the annular flange, said ring being positioned and spaced below the head as molded and being concentric with the sleeve, said ring being located above the flange upon initial reception of the sleeve on the neck portion with the ring above the flange, the internal diameter of the ring being slightly less than the external diameter of the flange and the ring being expandable when mechanically pushed down over the flange in order to descend past the flange and constrict below the flange so as to be captively retained on the neck portion of the bottle below the flange; and (d) at least one set of flexible elongated tethers constituting a pair of tethers, each tether of said pair having one end connected to the ring and the other end connected to the head, said tethers joining the ring to the head, the points of connection of the tethers of each pair to the head being spaced from one another and the points of connections of the tethers to the ring being spaced from one another, the tethers of each pair being in a folded state as molded and each tether having a length as molded substantially greater than the distance between its ends as molded, each tether including at least a pair of branches and a retroverted bend interconnected thereby, at least one retroverted bend of one tether on the set having its closed end facing and adjacent to the closed end of the retroverted bend of the other tether and joined thereto by an energy-absorbing link molded in one piece with the tethers, said link assimilating a portion of the force that would tend to propel the sleeve away from the neck portion of the bottle upon removal of the sleeve from said neck portion.

2. A corking unit as set forth in claim one in which there are two sets of tethers.

3. A corking unit as set forth in claim 1 in which there is at least one short frangible bridge connecting at least one tether to some other element of the unit, said frangible bridge being broken when the ring is forced over the flange.

4. A corking unit as set forth in claim 1 wherein at least one frangible bridge connects the tether of one set to the tether of the same set, said frangible bridge being broken when the ring is forced over the flange.

5. A corking unit as set forth in claim 1 wherein each folded tether is arcuate and does not extend beyond the radius of the ring or of the head.

6. A corking unit as set forth in claim 1 wherein there are two sets of tethers and wherein a retroverted bend of one set has its inner side facing and widely spaced from the inner side of a retroverted bend of a tether of the other set.

7. A corking unit as set forth in claim 1 wherein the energy-absorbing link is a linear low density polyethelene and is approximately one-eighth of an inch in length.

8. A corking unit as set forth in claim 7 wherein the energy-absorbing link has a rectangular cross-section of approximately 0.003 square inches.

9. For use with a bottle containing pressurized carbonated water based liquid contents and having a body portion, an elongated neck portion, and a mouth portion, a corking unit comprising:

(a) an elongated stopper insertable with frictional engagement through the mouth portion into the neck portion of the bottle;

(b) a pair of flexible folded tethers;

(c) means connecting one end of each tether to a different one of a pair of spaced points on said stopper;

(d) means connecting the other ends of the tethers to spaced points on said bottle;

(e) an energy-absorbing link joining portions of said tethers intermediate their ends to one another and adapted to be tensioned as the tethers unfold when the stopper leaves the mouth of the bottle so as to assimilate a portion of the force that would tend to propel the stopper away from the neck portion of the bottle.

10. A bottle for use with a tether, a headed stopper having a flexible elongated pair of folded tethers connected adjacent one pair of ends to the head of the stopper and an elastomeric ring including means for connection to the tethers adjacent the other ends;

said bottle adapted to contain pressurized carbonated water-based liquid contents, said bottle comprising:

(a) a neck with (b) a finish which includes (c) a pair of annular flanges closely axially spaced together near the mouth of the bottle, the outer diameter of the flange closer to the mouth being slightly larger than the inner diameter of the ring so that the ring can be pushed down over this flange expanding as it does so and constricting after it passes such flange (d) the next lower flange having a diameter larger than the diameter of the flange above it, (e) the two flanges being close enough to one another to inhibit a user from forcing the ring up over the flange closer to the mouth.

11. A bottle as set forth in claim 10 wherein the axial spacing from crest to crest between the two flanges is from about $\frac{1}{4}$ to $\frac{1}{2}$ inch.

* * * * *